US008441426B2

(12) United States Patent
Chung et al.

(10) Patent No.: US 8,441,426 B2
(45) Date of Patent: May 14, 2013

(54) DRIVING APPARATUS FOR DRIVING A LIQUID CRYSTAL DISPLAY PANEL

(75) Inventors: Chun-Fan Chung, Hsin-Chu (TW); Sheng-Kai Hsu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 1062 days.

(21) Appl. No.: 12/425,398

(22) Filed: Apr. 17, 2009

(65) Prior Publication Data

US 2010/0207930 A1 Aug. 19, 2010

(30) Foreign Application Priority Data

Feb. 17, 2009 (TW) ..... 98104947 A

(51) Int. Cl.
*G09G 3/36* (2006.01)

(52) U.S. Cl.
USPC ..... 345/99; 345/98; 345/204

(58) Field of Classification Search ..... 345/204–215, 345/87–104
See application file for complete search history.

(56) References Cited

U.S. PATENT DOCUMENTS

| | | | | |
|---|---|---|---|---|
| 6,937,111 | B2 | 8/2005 | Kwon | |
| 7,129,924 | B2 * | 10/2006 | Pai | 345/103 |
| 7,705,953 | B2 * | 4/2010 | Sato | 349/151 |
| 8,154,538 | B2 * | 4/2012 | Ryu | 345/204 |
| 8,279,206 | B2 * | 10/2012 | Ryu | 345/204 |
| 2004/0104903 | A1 * | 6/2004 | You | 345/204 |
| 2005/0068310 | A1 * | 3/2005 | Ishii | 345/204 |
| 2005/0083289 | A1 * | 4/2005 | Yang | 345/100 |
| 2006/0256099 | A1 * | 11/2006 | Tashiro | 345/204 |
| 2008/0094339 | A1 * | 4/2008 | Lin et al. | 345/98 |
| 2008/0136464 | A1 | 6/2008 | Kim et al. | |
| 2008/0170052 | A1 * | 7/2008 | Ryu | 345/204 |
| 2008/0170063 | A1 * | 7/2008 | Ryu | 345/214 |
| 2008/0211791 | A1 * | 9/2008 | Ryu | 345/204 |
| 2008/0225036 | A1 * | 9/2008 | Song et al. | 345/213 |
| 2008/0238819 | A1 | 10/2008 | Ryu | |
| 2008/0316382 | A1 * | 12/2008 | Sato | 349/33 |

FOREIGN PATENT DOCUMENTS

| | | | |
|---|---|---|---|
| CN | 1419287 | A | 5/2003 |
| CN | 2847703 | Y | 12/2006 |
| EP | 0588554 | A2 | 3/1994 |
| JP | 2001345867 | A | 12/2001 |
| JP | 200573073 | A | 3/2005 |
| JP | 2006235452 | A | 9/2006 |
| KR | 1020060016515 | A | 2/2006 |
| TW | I254903 | | 5/2006 |

* cited by examiner

*Primary Examiner* — Dmitriy Bolotin
(74) *Attorney, Agent, or Firm* — Winston Hsu; Scott Margo

(57) ABSTRACT

A driving apparatus for driving a liquid crystal display panel includes a timing controller, a plurality of pairs of transmission lines, a plurality of source driving circuits, a plurality of terminal resistors, and a plurality of auxiliary resistors. The timing controller functions to generate a plurality of differential signals outputted via a plurality of output ports. Each output port includes two output ends for outputting a corresponding differential signal. Each pair of transmission lines is coupled to the timing controller for receiving a corresponding differential signal. Each source driving circuit is coupled to the pairs of transmission lines for receiving the differential signals so as to generate a plurality of data signals. Each terminal resistor is coupled between two terminals of a corresponding pair of transmission lines. Each auxiliary resistor is coupled between two output ends of a corresponding output port of the timing controller.

7 Claims, 10 Drawing Sheets

DRIVING APPARATUS FOR DRIVING A LIQUID CRYSTAL DISPLAY PANEL

BACKGROUND OF THE INVENTION

1. Field of the Invention

The present invention relates to a driving apparatus, and more particularly, to a driving apparatus for driving a liquid crystal display panel.

2. Description of the Prior Art

Because the liquid crystal display (LCD) has advantages of thin appearance, low power consumption, and low radiation, the liquid crystal display has been widely applied in various electronic products for panel displaying. The operation of a liquid crystal display is featured by varying voltage drops between opposite sides of a liquid crystal layer for twisting the angles of the liquid crystal molecules in the liquid crystal layer so that the transparency of the liquid crystal layer can be controlled for illustrating images with the aid of the light source provided by a backlight module. In general, the liquid crystal display comprises a driving apparatus and a liquid crystal display panel. The driving apparatus is employed to provide a plurality of data signals to the liquid crystal display panel based on an image signal, a horizontal synchronization signal, a vertical synchronization signal, a data enable signal and a clock signal.

Along with the demands of high color depth, high resolution and high frame rate in advanced liquid crystal displays under developing, the working frequency regarding an image display operation is required to be much higher. However, in the operation of a prior-art driving apparatus, the signal qualities of the differential signals received by a plurality of source driving circuits are relatively low and quite non-uniform. Since the source driving circuit receiving the worst differential signal is also required to work properly, the working frequency regarding signal transmission must be lowered, and therefore the prior-art driving apparatus is not suitable for a high-frequency operation. In other words, the differential signals having low signal quality are not suitable for high-frequency signal transmission. For instance, regarding a period jitter range of 200 pico-seconds, a driving apparatus may still work properly based on a working frequency of 100 MHz. However, based on a working frequency of 1 GHz, the 1 GHz-based transmission interface of a driving apparatus is then unable to receive the differential signals properly. That is, if the differential signal having low signal quality is transmitted under high working frequency, the noise tolerance will decrease significantly, and therefore voltage-level misjudgments of the differential signal are likely to occur in that the source driving circuit is hard to identify different voltage levels of the differential signal received or even hard to single out each data bit of the differential signal.

SUMMARY OF THE INVENTION

In accordance with an embodiment of the present invention, a driving apparatus for driving a liquid crystal display panel is provided. The driving apparatus comprises a timing controller, a plurality of pairs of transmission lines, a plurality of source driving circuit, a plurality of terminal resistors and a plurality of auxiliary resistors.

The timing controller functions to generate a plurality of differential signals. The timing controller comprises a plurality of output ports. Each of the output ports comprises two output ends for outputting a corresponding differential signal. Each pair of transmission lines comprises two transmission lines respectively coupled to the two output ends of one corresponding output port of the timing controller for receiving a corresponding differential signal. The plurality of source driving circuits are utilized for generating a plurality of data signals furnished to the liquid crystal display panel based on the differential signals. Each source driving circuit is coupled to the plurality of pairs of transmission lines for receiving the differential signals. Each source driving circuit comprises a plurality of input ports. Each of the input ports has two input ends coupled to a corresponding pair of transmission lines. Each of the terminal resistors is coupled between two terminals of one corresponding pair of transmission lines. The auxiliary resistors are coupled to the transmission lines between the timing controller and the source driving circuits.

In accordance with another embodiment of the present invention, a driving apparatus for driving a liquid crystal display panel is provided. The driving apparatus comprises a timing controller, a plurality of pairs of transmission lines, a plurality of source driving circuits and a plurality of terminal resistors.

The timing controller functions to generate a plurality of differential signals. The timing controller comprises a plurality of output ports. Each of the output ports comprising two output ends for outputting a corresponding differential signal. Each pair of transmission lines comprises two transmission lines respectively coupled to the two output ends of one corresponding output port of the timing controller for receiving a corresponding differential signal. The plurality of source driving circuits are utilized for generating a plurality of data signals furnished to the liquid crystal display panel based on the differential signals. Each source driving circuit is coupled to the plurality of pairs of transmission lines for receiving the differential signals. Each source driving circuit comprises a plurality of input ports. Each of the input ports has two input ends coupled to a corresponding pair of transmission lines. Each of the terminal resistors is coupled between the two input ends of one corresponding input port of a corresponding source driving circuit of the source driving circuits. The corresponding source driving circuit is coupled to the terminals of the transmission lines.

In accordance with another embodiment of the present invention, a driving apparatus for driving a liquid crystal display panel is provided. The driving apparatus comprises a timing controller, a plurality of pairs of transmission lines, a plurality of source driving circuits and a plurality of terminal resistors. The timing controller comprises a plurality of differential signal transmitters and a plurality of auxiliary resistors.

The timing controller functions to generate a plurality of differential signals. Each of the differential signal transmitters comprises two output ends for outputting a corresponding differential signal. Each of the auxiliary resistors is coupled between the two output ends of one corresponding differential signal transmitter. Each pair of transmission lines comprises two transmission lines respectively coupled to the two output ends of one corresponding differential signal transmitter for receiving a corresponding differential signal. The plurality of source driving circuits are utilized for generating a plurality of data signals furnished to the liquid crystal display panel based on the differential signals. Each source driving circuit is coupled to the plurality of pairs of transmission lines for receiving the differential signals. Each source driving circuit comprises a plurality of input ports. Each of the input ports has two input ends coupled to a corresponding pair of transmission lines. Each of the terminal resistors is coupled between two terminals of one corresponding pair of transmission lines.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2(*b*) is an eye-pattern diagram showing the differential signal regarding the operation of the driving apparatus shown in FIG. 1, having time along the abscissa.

DETAILED DESCRIPTION

Hereinafter, preferred embodiments of the present invention will be described in detail with reference to the accompanying drawings. Here, it is to be noted that the present invention is not limited thereto.

Figure 1:
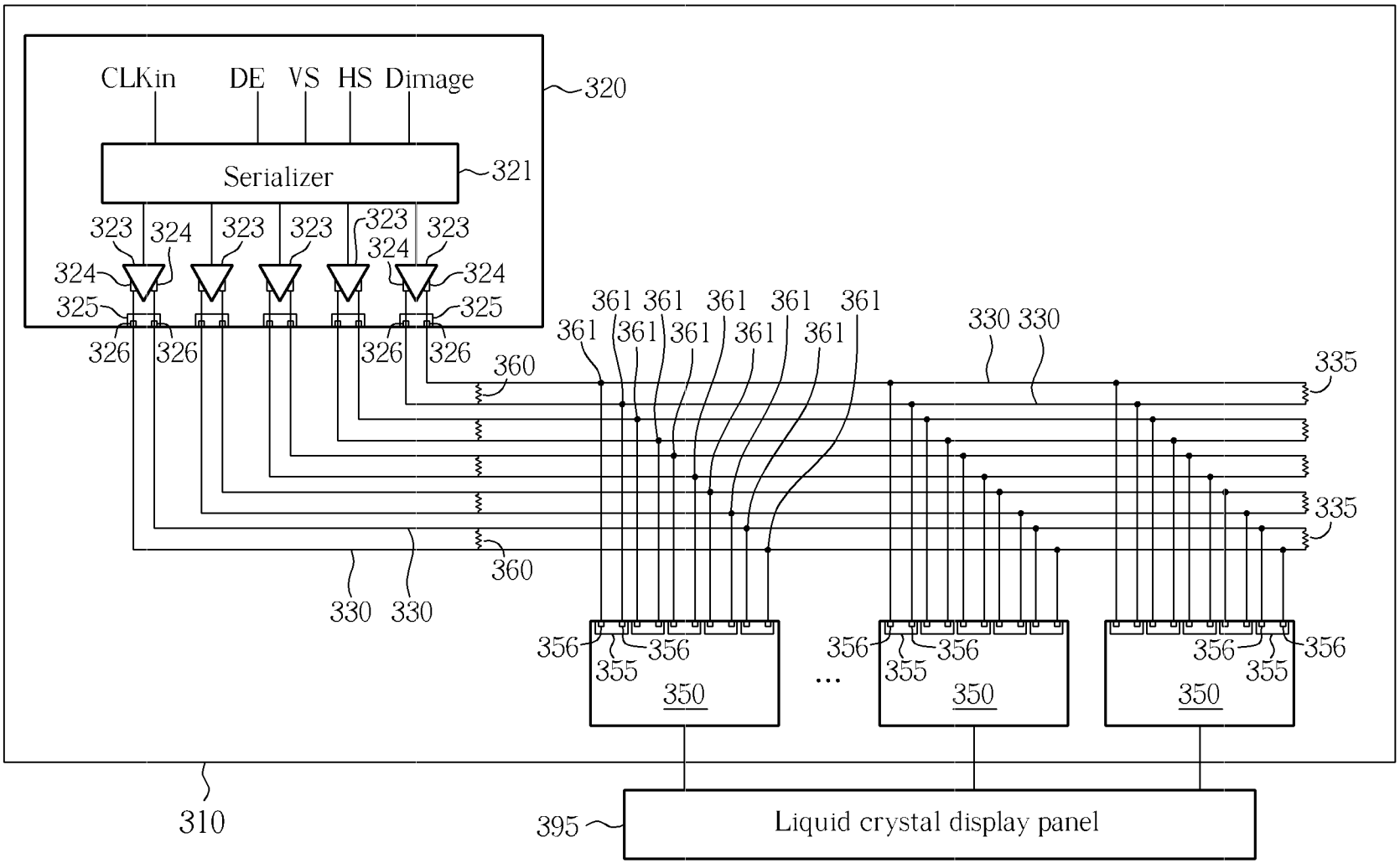
FIG. 1 is a structural diagram schematically showing a driving apparatus in accordance with a first embodiment of the present invention.

FIG. 1 is a structural diagram schematically showing a driving apparatus in accordance with a first embodiment of the present invention. As shown in FIG. 1, the driving apparatus 310 comprises a timing controller 320, a plurality of pairs of transmission lines 330, a plurality of terminal resistors 335, a plurality of first auxiliary resistors 360 and a plurality of source driving circuits 350. The timing controller 320 comprises a serializer 321, a plurality of differential signal transmitters 323 and a plurality of output ports 325. With the aid of a clock signal CLKin, the serializer 321 is employed to perform a signal serializing operation on an image signal Dimage, a horizontal synchronization signal HS, a vertical synchronization signal VS and a data enable signal DE for generating a plurality of serial signals forwarded to the plurality of differential signal transmitters 323. Each differential signal transmitter 323 comprises two output ends 324 and functions to convert each received serial signal into one differential signal outputted to a corresponding output port 325 via the two output ends 324. Each output port 325 comprises two output ends 326 for outputting one corresponding differential signal. The differential signals transmitted from the differential signal transmitters 323 can be mini low voltage differential signals (mini-LVDSs) or reduced swing differential signals (RSDSs).

Each pair of transmission lines 330 is coupled to the two output ends 326 of one corresponding output port 325 of the timing controller 320 for receiving a corresponding differential signal. Each first auxiliary resistor 360 is coupled between the two output ends 326 of one corresponding output port 325 of the timing controller 320. As shown in FIG. 1, the first auxiliary resistors 360 are actually disposed between the output ports 325 of the timing controller 320 and a plurality of nodes 361. The first auxiliary resistors 360 are put in use for reducing effect of signal reflection on the transmission path. Since the differential signals transmitted have higher signal quality around the terminal resistors 335 as indicated by the results of related experiments, the first auxiliary resistors 360 are then disposed around the fore terminals of transmission lines 330, i.e. adjacent to the output ports 325 of the timing controller 320, for reducing the effect of signal reflection and improving transmission signal quality. Each terminal resistor 335 is coupled between two rear terminals of one corresponding pair of transmission lines 330. Each source driving circuit 350 comprises a plurality of input ports 355. Each input port 355 comprises two input ends 356 coupled to a corresponding pair of transmission lines 330 for receiving a corresponding differential signal. It is noted that the positions of the nodes 361 are between the output ports 325 of the timing controller 320 and the input ends 356 of the source driving circuits 350. The source driving circuits 350 are employed to generate a plurality of data signals based on the differential signals received from the plurality of pairs of transmission lines 330. The data signals are then forwarded to drive a liquid crystal display panel 395 for illustrating images.

As aforementioned, the working frequency is directly corresponding to the transmission signal quality. In the architecture of the driving apparatus 310 shown in FIG. 1, because the source driving circuits 350 are functioning as a plurality of loads, a plurality of branches are required to branch from the transmission path of the differential signals for coupling the loads, and therefore the signal quality of the differential signal transmitted becomes worse due to the branches and the loads. For that reason, some prior-art driving apparatus makes use of point-to-point architecture for devising transmission routings, i.e. each transmission path is attached with single source driving circuit (single load) for improving transmission signal quality so as to achieve high-frequency operation.

However, by making use of a plurality of source driving circuits and sharing common transmission lines, the architectures of the timing controller and the transmission interface can be simplified significantly. Therefore, as aforementioned, in the driving apparatus 310 of the present invention, the first auxiliary resistors 360 are further disposed around the fore terminals of transmission lines 330 for reducing the effect of signal reflection and improving transmission signal quality. Accordingly, the driving apparatus 310 is able to perform high frequency transmission of the differential signal based on simplified architectures of the timing controller 320 and the transmission interface shown in FIG. 1.

Figure 2:
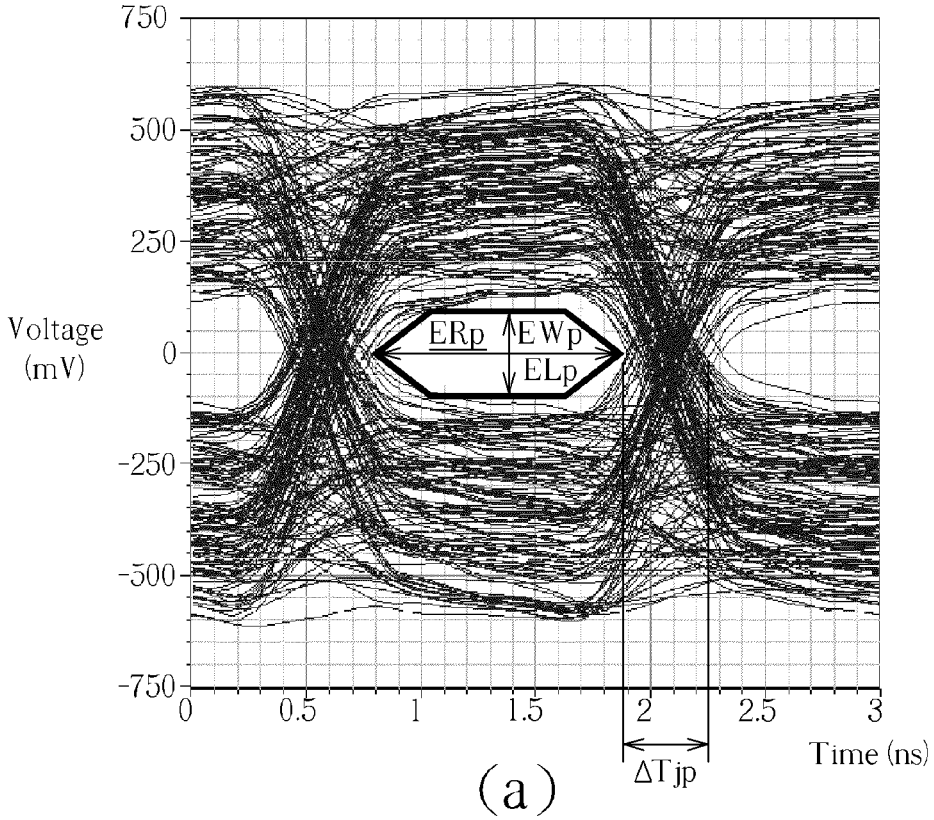
FIG. 2(*a*) is an eye-pattern diagram showing the differential signal regarding the operation of a prior-art driving apparatus, having time along the abscissa.
Figure 2:
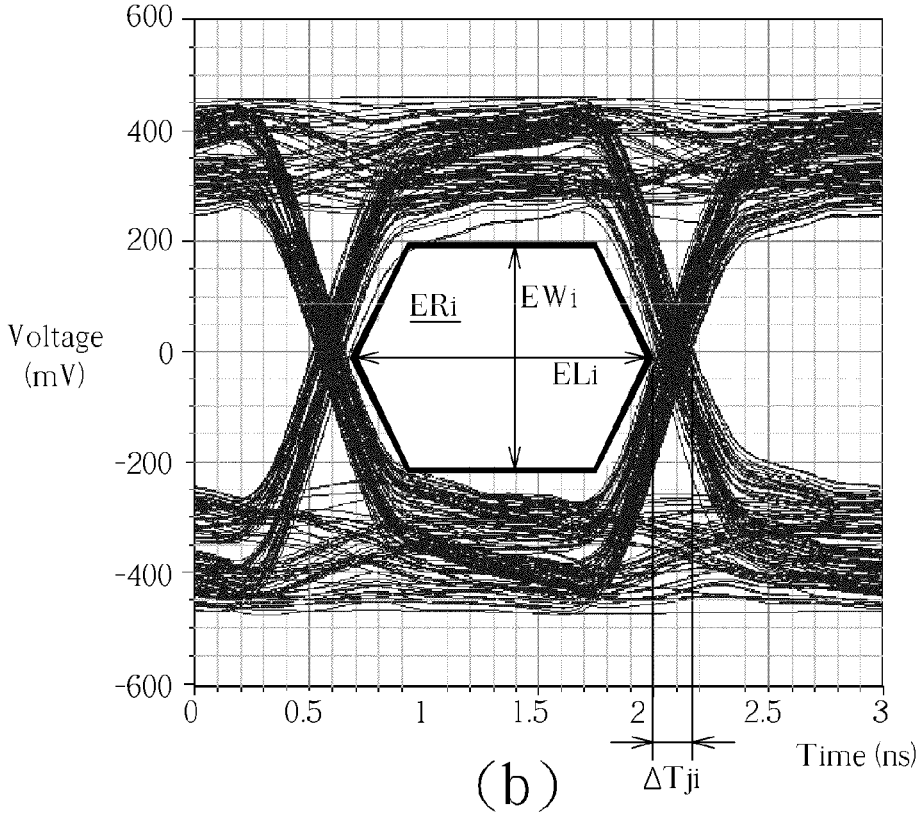

Please refer to FIGS. 2(*a*) and 2(*b*). FIG. 2(*a*) is an eye-pattern diagram showing the differential signal regarding the operation of a prior-art driving apparatus, having time along the abscissa. FIG. 2(*b*) is an eye-pattern diagram showing the differential signal regarding the operation of the driving apparatus shown in FIG. 1, having time along the abscissa. In general, the signal integrity (SI) of the differential signal is used to indicate corresponding signal quality. In the eye-pattern diagram of the differential signal, the eye pattern region having a larger pattern area indicates that the signal integrity is better, i.e. the signal quality of the differential signal is superior. The area size of the eye pattern region is determined by the length and width of the eye pattern region. As the length of the eye pattern is greater, the period jitter range is smaller, and therefore the effective judge interval of each period is longer for each data bit of the differential signal to be easily singled out in a high-frequency operation. As the width of the eye pattern is wider, the noise tolerance is higher, and therefore the voltage-level misjudging rate of the differential signal can be reduced.

As shown in FIGS. 2(*a*) and 2(*b*), the eye pattern region ERi of the differential signal regarding the operation of the driving apparatus 310 of the present invention is significantly greater than the eye pattern region ERp of the differential signal regarding the operation of the prior-art driving apparatus. Since the length ELi of the eye pattern region ERi is greater than the length ELp of the eye pattern region ERp, the period jitter range ΔTji is therefore less than the period jitter range ΔTjp, i.e. the driving apparatus 310 of the present invention is more suitable for a high-frequency operation. Furthermore, since the width EWi of the eye pattern region ERi is wider than the width EWp of the eye pattern region ERp, the driving apparatus 310 of the present invention is able to tolerate higher noise for reducing the voltage-level misjudging rate of the differential signal. It is noted that the differential signal received by a source driving circuit is featured by a wider width or a greater length of the corresponding eye pattern region in the operations of the following embodiments to be set forth according to the present invention.

Figure 3:
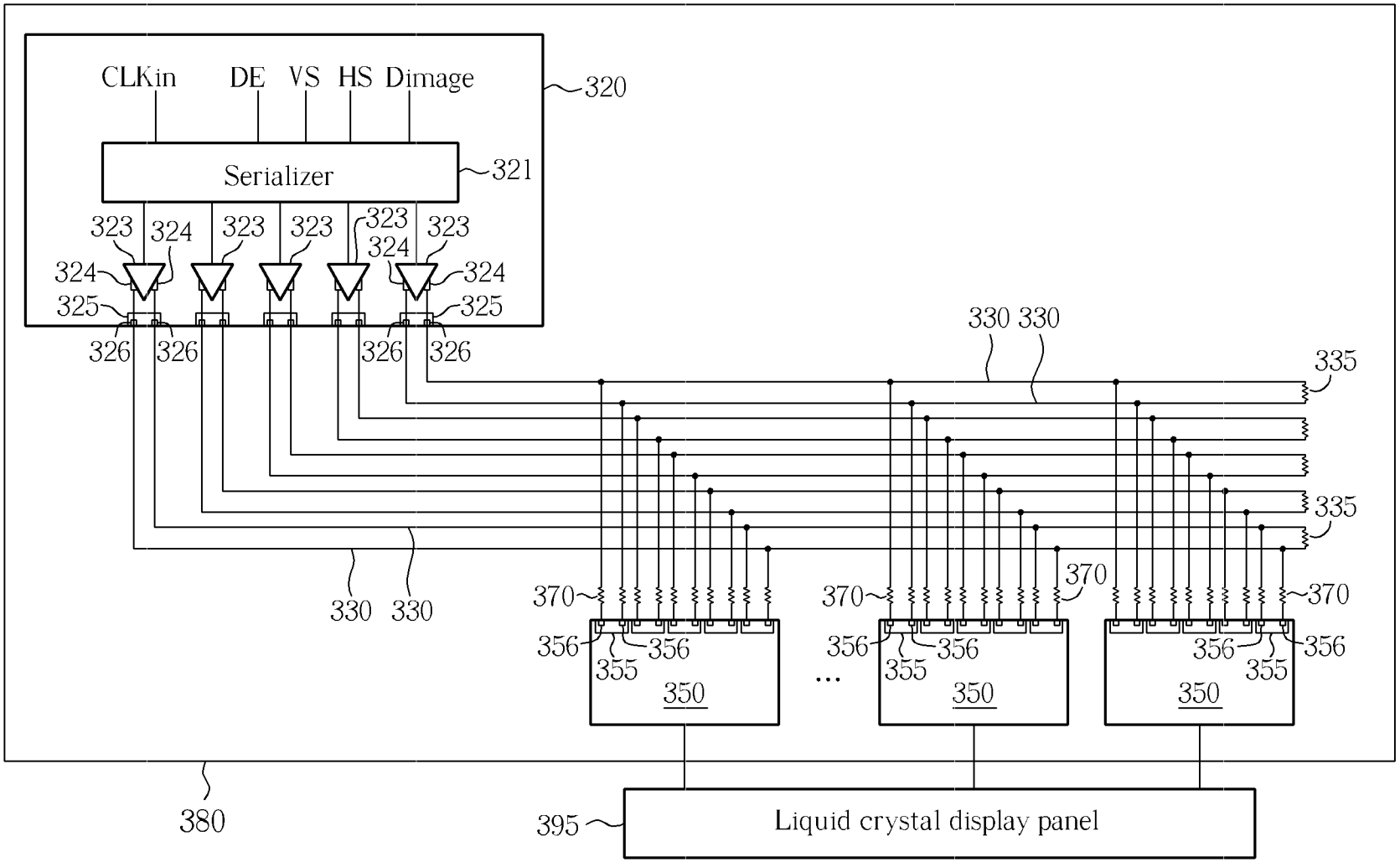
FIG. 3 is a structural diagram schematically showing a driving apparatus in accordance with a second embodiment of the present invention.

FIG. 3 is a structural diagram schematically showing a driving apparatus in accordance with a second embodiment of the present invention. As shown in FIG. 3, the driving apparatus 380 comprises the timing controller 320, the plurality of pairs of transmission lines 330, the plurality of terminal resistors 335, a plurality of second auxiliary resistors 370 and the plurality of source driving circuits 350. Each second auxiliary resistor 370 is coupled between a corresponding transmission line 330 and a corresponding input end 356 of one corresponding source driving circuit 350. Referring to FIGS. 3 and 1, it is obvious that the driving apparatus 380 is similar to the driving apparatus 310, differing only in that the first auxiliary resistors 360 are omitted and the second auxiliary resistors 370 are added in the driving apparatus 380.

As aforementioned, the transmission path of the differential signal has a plurality of branches for coupling a plurality of source driving circuits 350, and therefore the branches and the source driving circuits 350 are likely to cause low signal transmission quality. In general, the signal transmission quality is degraded essentially by two causes: (1) the branches of the transmission path and the source driving circuits 350 coupled to the branches degrade entire signal transmission quality; and (2) the effect of significant signal reflection caused by impedance discontinuity between the higher impedance of the transmission path and the lower input impedance of the source driving circuits 350 also degrade entire signal transmission quality.

In order to improve the signal transmission quality of the differential signal, the second auxiliary resistors 370 are coupled to the input ends 356 of the source driving circuits 350 for boosting the input impedance of the source driving circuits 350. The second auxiliary resistors 370 have two advantages of: (1) each second auxiliary resistor 370 is capable of reducing the influence of the corresponding branch on the whole transmission path for improving entire signal transmission quality so that the signal quality of the differential signals received by each source driving circuit 350 is improved accordingly; and (2) the effect of signal reflection caused by impedance discontinuity is reduced in that the input impedance of the source driving circuits 350 is increased by the second auxiliary resistors 370 for approaching the impedance of the transmission path.

Furthermore, the second auxiliary resistors 370 can also be put in use for regulating and distributing different signal qualities of the differential signals received by different source driving circuits 350. Since the signal qualities of the differential signals received by different source driving circuits are quite non-uniform in the operation of prior-art driving apparatus, the discrepancy of the best and worst signal qualities thereof is then quite significant, and therefore the working frequency regarding signal transmission should be pulled down so that the source driving circuit receiving the worst differential signal is able to work properly. However, in accordance with the present invention, the driving apparatus 380 is able to regulate and distribute the signal qualities of the differential signals received by the source driving circuits 350 based on the second auxiliary resistors 370. In one embodiment, the second auxiliary resistors 370 are employed to degrade the best signal quality and to upgrade the worst signal quality so that the working frequency can be boosted following an improvement of the worst signal quality.

Figure 4:
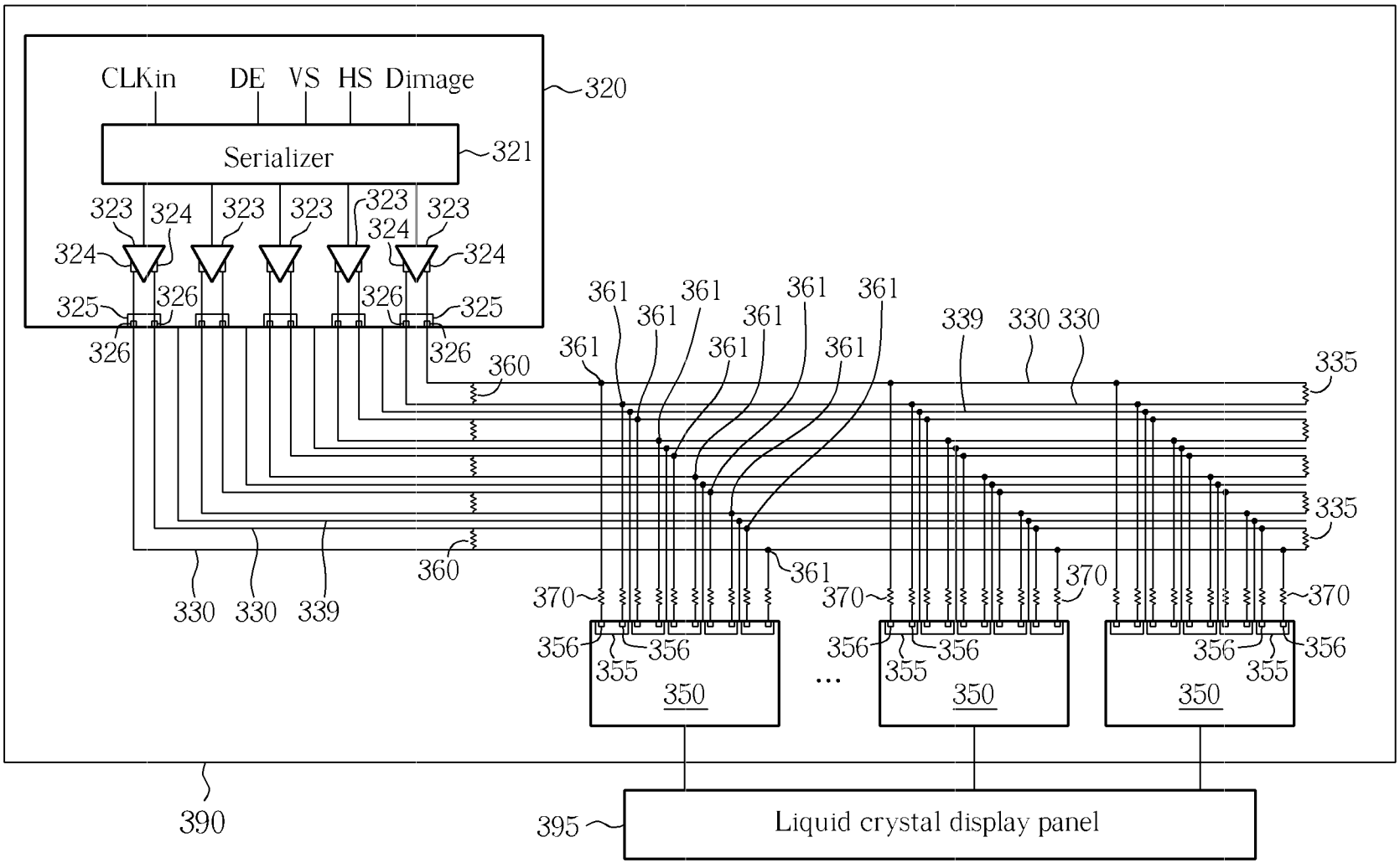
FIG. 4 is a structural diagram schematically showing a driving apparatus in accordance with a third embodiment of the present invention.

FIG. 4 is a structural diagram schematically showing a driving apparatus in accordance with a third embodiment of the present invention. As shown in FIG. 4, the driving apparatus 390 comprises the timing controller 320, the plurality of pairs of transmission lines 330, a plurality of shielding lines 339, the plurality of terminal resistors 335, the plurality of first auxiliary resistors 360, the plurality of second auxiliary resistors 370 and the plurality of source driving circuits 350. All the shielding lines 339 are configured to receive a ground voltage or a fixed voltage. Each shielding line 339 is disposed between adjacent pairs of transmission lines 330 for avoiding crosstalk interference regarding adjacent pairs of transmission lines 330 so as to improve signal quality. The driving apparatus 390 is similar to the driving apparatus 310 shown in FIG. 1, differing only in that the second auxiliary resistors 370 and the shielding lines 339 are added, and therefore further similar discussion thereof is omitted.

Figure 5:
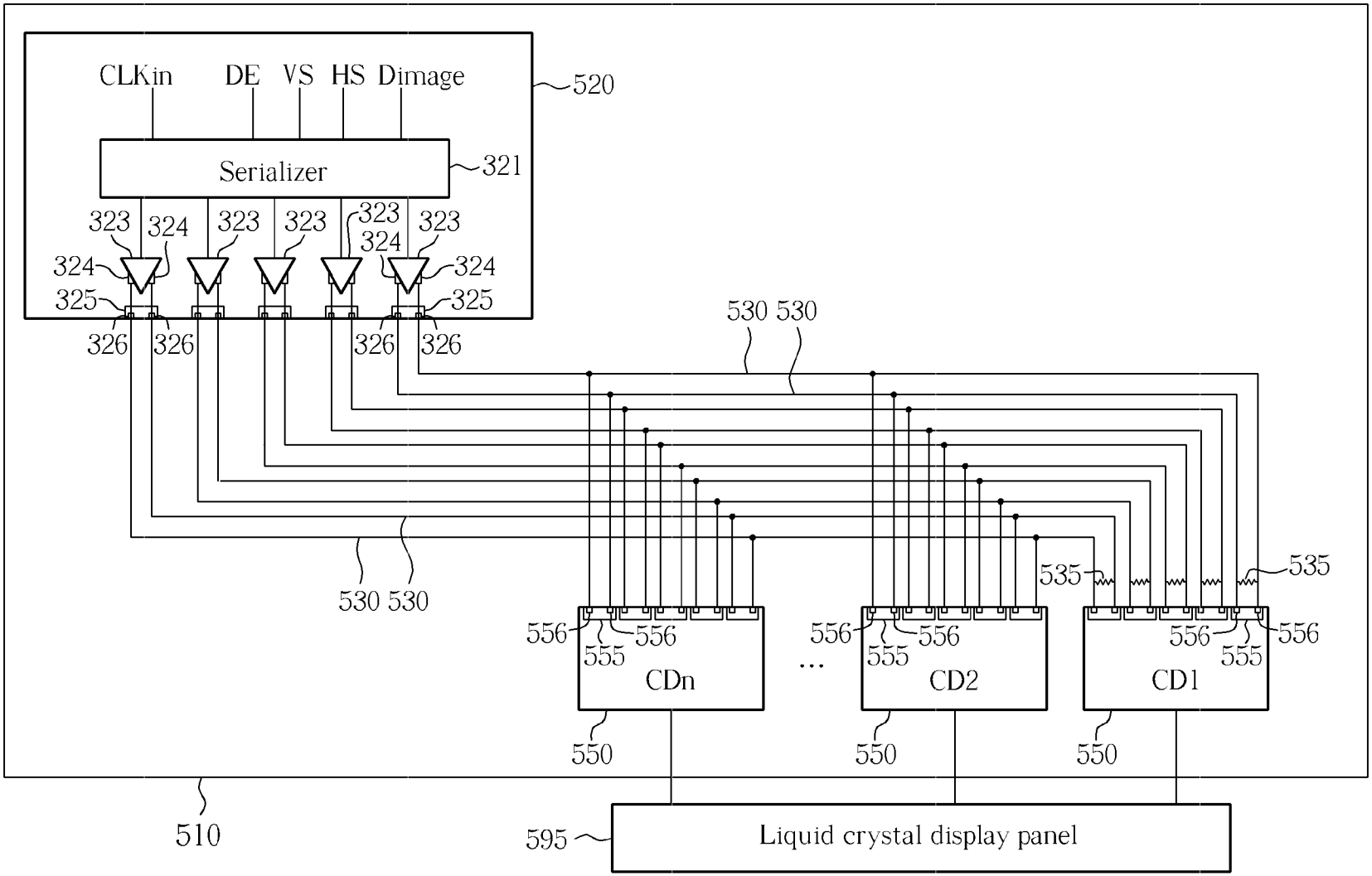
FIG. 5 is a structural diagram schematically showing a driving apparatus in accordance with a fourth embodiment of the present invention.

FIG. 5 is a structural diagram schematically showing a driving apparatus in accordance with a fourth embodiment of the present invention. As shown in FIG. 5, the driving apparatus 510 comprises a timing controller 520, a plurality of pairs of transmission lines 530, a plurality of terminal resistors 535 and a plurality of source driving circuits 550. The internal structure of timing controller 520 is identical to that of the timing controller 320 shown in FIG. 1. Each pair of transmission lines 530 is coupled to the two output ends 326 of one corresponding output port 325 of the timing controller 520 for receiving a corresponding differential signal. The plurality of source driving circuits 550 comprises a first source driving circuit CD1, a second source driving circuit CD2, . . . , and an nth source driving circuit CDn. The first source driving circuit CD1 is positioned at the rear terminals of the transmission lines 530. The nth source driving circuit CDn is positioned nearby the fore terminals of the transmission lines 530, i.e. adjacent to the timing controller 520. Each source driving circuit 550 comprises a plurality of input ports 555. Each input port 555 comprises two input ends 556 coupled to a corresponding pair of transmission lines 530 for receiving a corresponding differential signal. Each terminal resistor 535 is coupled between the two input ends 556 of one corresponding input port 555 of the first source driving circuit CD1. The source driving circuits 550 are put in use for generating a plurality of data signals based on the differential signals received from the plurality of pairs of transmission lines 530. The data signals are forwarded to drive a liquid crystal display panel 595 for illustrating images.

Figure 6:
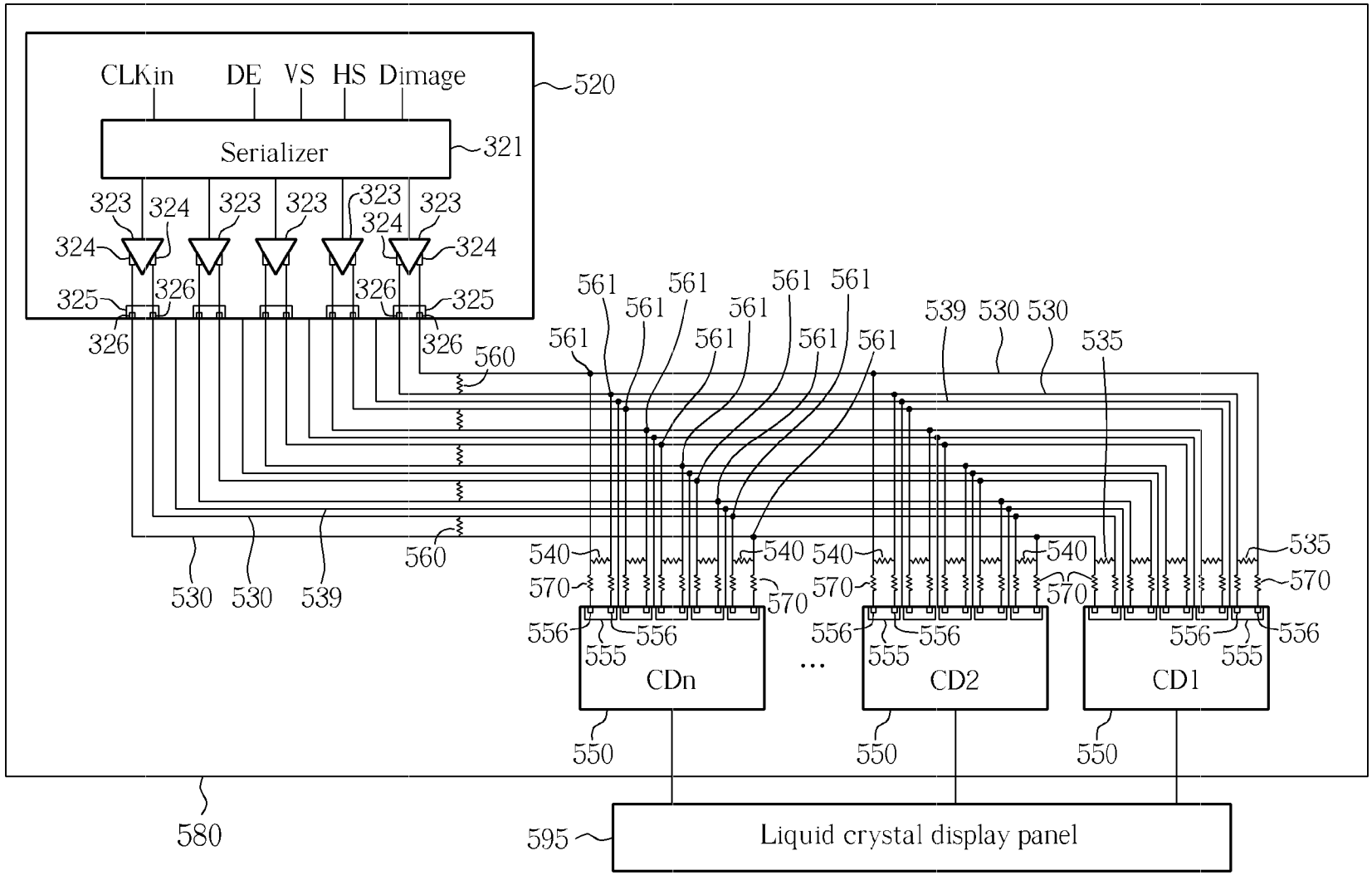
FIG. 6 is a structural diagram schematically showing a driving apparatus in accordance with a fifth embodiment of the present invention.

FIG. 6 is a structural diagram schematically showing a driving apparatus in accordance with a fifth embodiment of the present invention. As shown in FIG. 6, the driving apparatus 580 comprises the timing controller 520, the plurality of pairs of transmission lines 530, a plurality of shielding lines 539, the plurality of terminal resistors 535, a plurality of first auxiliary resistors 560, a plurality of second auxiliary resistors 540, a plurality of third auxiliary resistors 570 and the plurality of source driving circuits 550. Each first auxiliary resistor 560 is coupled between the two output ends 326 of one corresponding output port 325 of the timing controller 520. As shown in FIG. 6, the first auxiliary resistors 560 are actually disposed between the output ports 325 of the timing controller 520 and a plurality of nodes 561. All the shielding lines 539 are configured to receive a ground voltage or a fixed voltage. Each shielding line 539 is disposed between adjacent pairs of transmission lines 530 for avoiding crosstalk interference regarding adjacent pairs of transmission lines 530 so as to improve signal quality.

Each terminal resistor 535 is coupled between the two input ends 556 of one corresponding input port 555 of the first source driving circuit CD1. Each second auxiliary resistor 540 is coupled to the two input ends 556 of one corresponding input port 555 of the source driving circuits CD2~CDn. Each third auxiliary resistor 570 is coupled between a corresponding transmission line 530 and a corresponding input end 556 of one corresponding source driving circuit 550. The driving apparatus 580 is similar to the driving apparatus 510 shown in FIG. 5, differing only in that the shielding lines 539, the first auxiliary resistors 560, the second auxiliary resistors 540 and the third auxiliary resistors 570 are added, and therefore further similar discussion thereof is omitted. In another embodiment, only the two input ends 556 of each input port 555 of the nth source driving circuit CDn are coupled with a corresponding second auxiliary resistor 540, i.e. the two input ends 556 of each input port 555 of the source driving circuits CD2~CDn−1 are not coupled with any second auxiliary resistor 540.

Figure 7:
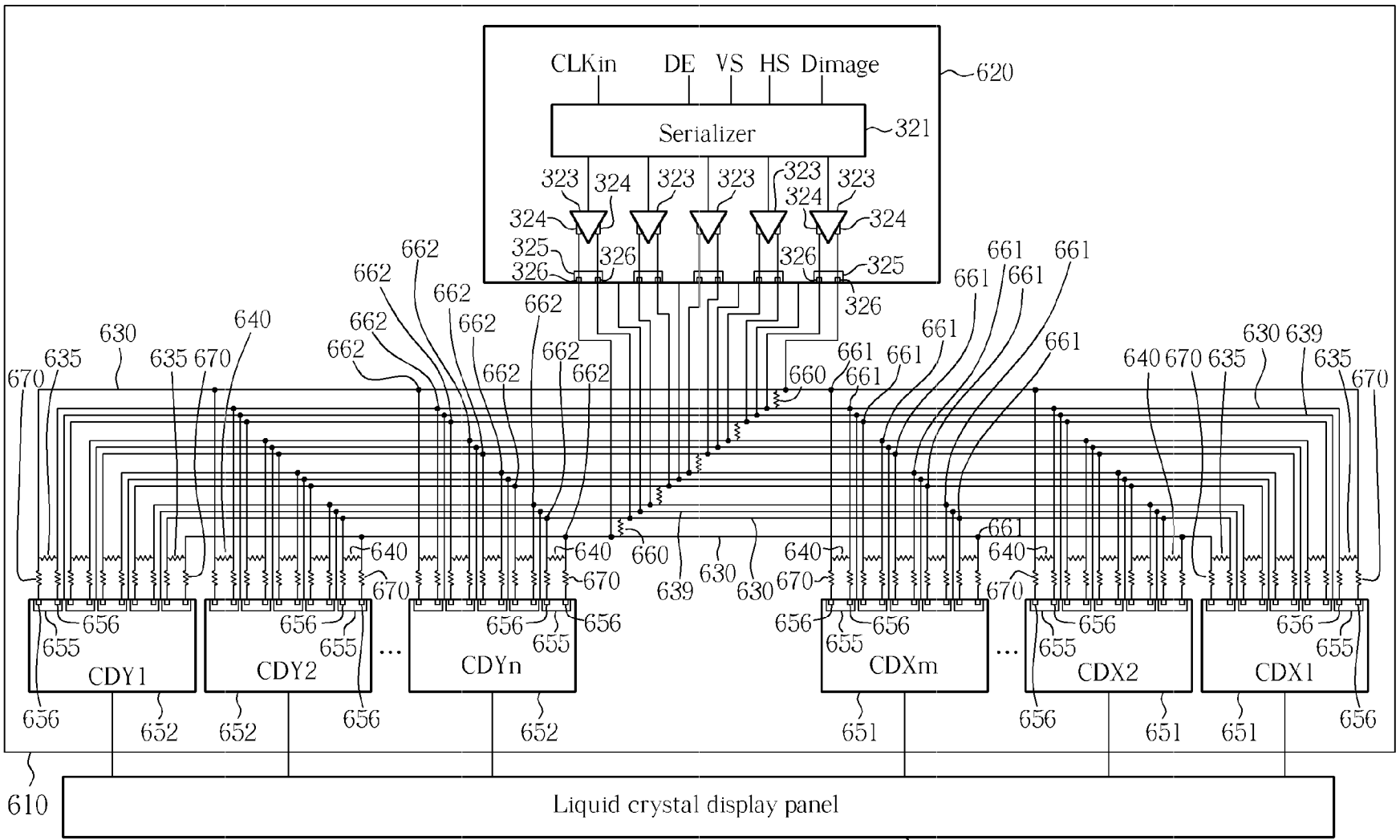
FIG. 7 is a structural diagram schematically showing a driving apparatus in accordance with a sixth embodiment of the present invention.

FIG. 7 is a structural diagram schematically showing a driving apparatus in accordance with a sixth embodiment of the present invention. As shown in FIG. 7, the driving apparatus 610 comprises a timing controller 620, a plurality of pairs of transmission lines 630, a plurality of shielding lines 639, a plurality of terminal resistors 635, a plurality of first auxiliary resistors 660, a plurality of second auxiliary resistors 640, a plurality of third auxiliary resistors 670, a plurality of right-side source driving circuits 651 and a plurality of left-side source driving circuits 652. The internal structure of timing controller 620 is identical to that of the timing controller 320 shown in FIG. 1. Each first auxiliary resistor 660 is coupled between the two output ends 326 of one corresponding output port 325 of the timing controller 620. As shown in FIG. 6, the first auxiliary resistors 660 are actually disposed between a plurality of nodes 661 and a plurality of nodes 662 adjacent to the output ports 325 of the timing controller 620. All the shielding lines 639 are configured to receive a ground voltage or a fixed voltage. Each shielding line 639 is disposed between adjacent pairs of transmission lines 630 for avoiding crosstalk interference regarding adjacent pairs of transmission lines 630 so as to improve signal quality.

The plurality of right-side source driving circuits 651 comprises a first right-side source driving circuit CDX1, a second right-side source driving circuit CDX2, . . . , and an mth right-side source driving circuit CDXm. The first right-side source driving circuit CDXL is positioned at right rear terminals of the transmission lines 630. The mth right-side source driving circuit CDXm is positioned nearby the right fore parts of the transmission lines 630, i.e. adjacent to the right side of the timing controller 620. The plurality of left-side source driving circuits 652 comprises a first left-side source driving circuit CDY1, a second left-side source driving circuit CDY2, . . . , and an nth left-side source driving circuit CDYn. The first left-side source driving circuit CDY1 is positioned at left rear terminals of the transmission lines 630. The nth left-side source driving circuit CDYn is positioned nearby the left fore parts of the transmission lines 630, i.e. adjacent to the left side of the timing controller 620. The numbers n and m are identical or different positive integers. Each right-side source driving circuit 651 comprises a plurality of input ports 655. Each input port 655 comprises two input ends 656 coupled to a corresponding pair of transmission lines 630 for receiving a corresponding differential signal. The couple-related structure of each left-side source driving circuit 652 is identical to that of the right-side source driving circuit 651.

The two input ends 656 of each input port 655 of the first right-side source driving circuit CDX1 are coupled with one corresponding terminal resistor 635. Also, the two input ends 656 of each input port 655 of the first left-side source driving circuit CDY1 are coupled with one corresponding terminal resistor 635. The two input ends 656 of each input port 655 of the right-side source driving circuits CDX2~CDXm are coupled with one corresponding second auxiliary resistor 640. Also, the two input ends 656 of each input port 655 of the left-side source driving circuits CDY2~CDYn are coupled with one corresponding second auxiliary resistor 640. Each third auxiliary resistor 670 is coupled between a corresponding transmission line 630 and a corresponding input end 656 of one corresponding right-side source driving circuit 651 or left-side source driving circuit 652. The right-side source driving circuits 651 and the left-side source driving circuits 652 are put in use for generating a plurality of data signals based on the differential signals received from the plurality of pairs of transmission lines 630. The data signals are forwarded to drive a liquid crystal display panel 695 for illustrating images. In another embodiment, only the two input ends 656 of each input port 655 of the mth right-side source driving circuit CDXm and the nth left-side source driving circuit CDYn are coupled with a corresponding second auxiliary resistor 640, i.e. the two input ends 656 of each input port 655 of the source driving circuits CDX2~CDXm-1 and CDY2~CDYn-1 are not coupled with any second auxiliary resistor 640.

Figure 8:
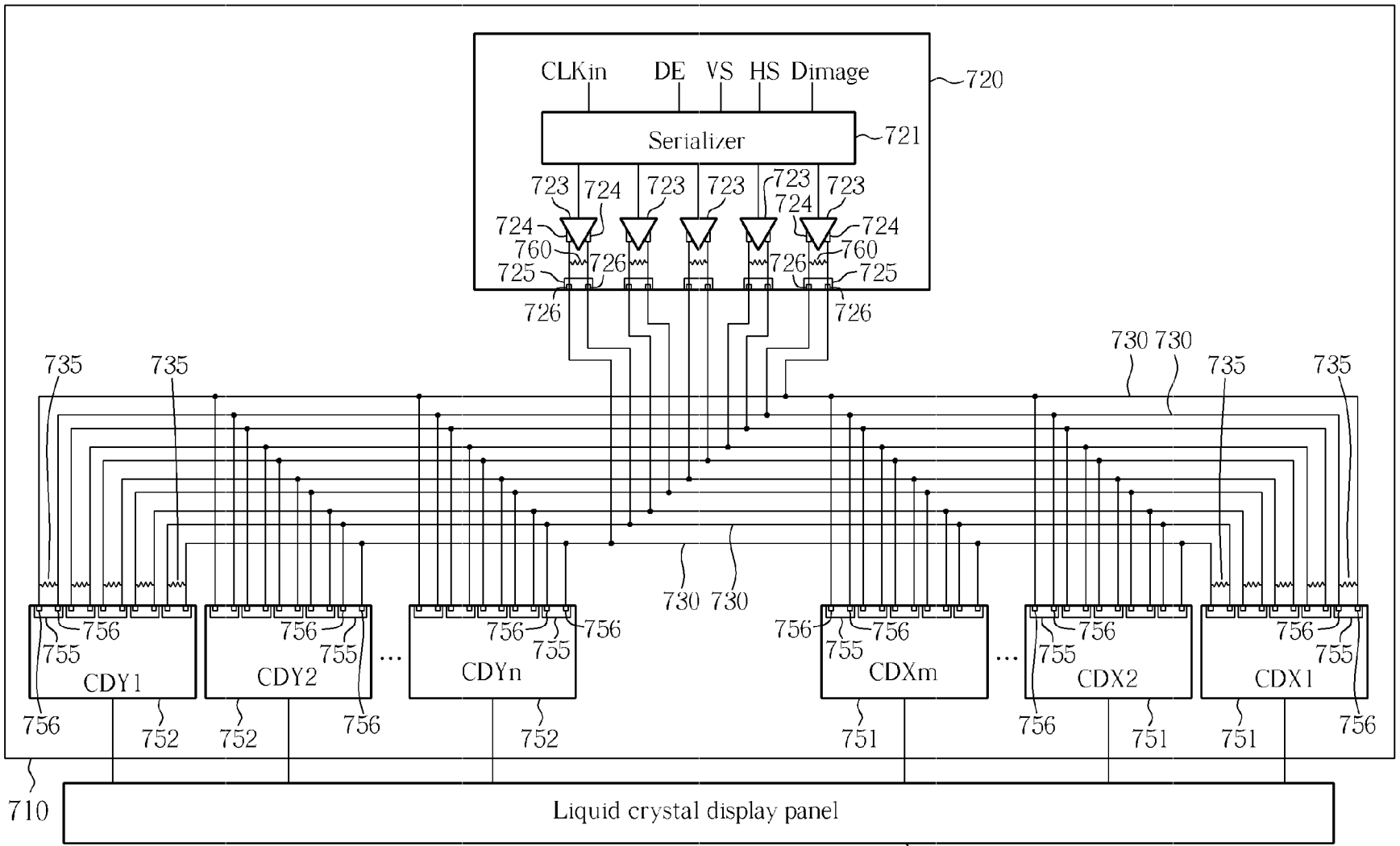
FIG. 8 is a structural diagram schematically showing a driving apparatus in accordance with a seventh embodiment of the present invention.

FIG. 8 is a structural diagram schematically showing a driving apparatus in accordance with a seventh embodiment of the present invention. As shown in FIG. 8, the driving apparatus 710 comprises a timing controller 720, a plurality of pairs of transmission lines 730, a plurality of terminal resistors 735, a plurality of right-side source driving circuits 751 and a plurality of left-side source driving circuits 752. The timing controller 720 comprises a serializer 721, a plurality of differential signal transmitters 723, a plurality of first auxiliary resistors 760 and a plurality of output ports 725.

With the aid of a clock signal CLKin, the serializer 721 is employed to perform a signal serializing operation on an image signal Dimage, a horizontal synchronization signal HS, a vertical synchronization signal VS and a data enable signal DE for generating a plurality of serial signals forwarded to the plurality of differential signal transmitters 723 respectively. Each differential signal transmitter 723 comprises two output ends 724 and functions to convert one received serial signal into a differential signal outputted to a corresponding output port 725 via the two output ends 724. Each first auxiliary resistor 760 is coupled between the two output ends 724 of one corresponding differential signal transmitter 723. Each output port 725 comprises two output ends 726 for outputting a corresponding differential signal. The differential signals can be mini low voltage differential signals or reduced swing differential signals.

The plurality of right-side source driving circuits 751 comprises a first right-side source driving circuit CDX1, a second right-side source driving circuit CDX2, . . . , and an mth right-side source driving circuit CDXm. The first right-side source driving circuit CDXL is positioned at right rear terminals of the transmission lines 730. The mth right-side source driving circuit CDXm is positioned nearby the right fore parts of the transmission lines 730, i.e. adjacent to the right side of the timing controller 720. The plurality of left-side source driving circuits 752 comprises a first left-side source driving circuit CDY1, a second left-side source driving circuit CDY2, . . . , and an nth left-side source driving circuit CDYn. The first left-side source driving circuit CDY1 is positioned at left rear terminals of the transmission lines 730. The nth left-side source driving circuit CDYn is positioned nearby the left fore parts of the transmission lines 730, i.e. adjacent to the left side of the timing controller 720. The numbers n and m are identical or different positive integers. Each right-side source driving circuit 751 comprises a plurality of input ports 755. Each input port 755 comprises two input ends 756 coupled to a corresponding pair of transmission lines 730 for receiving a corresponding differential signal. The couple-related structure of each left-side source driving circuit 752 is identical to that of the right-side source driving circuit 751. The two input ends 756 of each input port 755 of the first right-side source driving circuit CDX1 are coupled with one corresponding terminal resistor 735. Also, the two input ends 756 of each input port 755 of the first left-side source driving circuit CDY1 are coupled with one corresponding terminal resistor 735.

The right-side source driving circuits 751 and the left-side source driving circuits 752 are put in use for generating a plurality of data signals based on the differential signals received from the plurality of pairs of transmission lines 730. The data signals are forwarded to drive a liquid crystal display panel 795 for illustrating images. In one embodiment, the plurality of left-side source driving circuit 752 can be omitted, and only the plurality of right-side source driving circuit 751 are employed to generate the data signals for driving the liquid crystal display panel 795. Alternatively, in another embodiment, the plurality of right-side source driving circuit 751 can be omitted, and only the plurality of left-side source driving circuit 752 are employed to generate the data signals for driving the liquid crystal display panel 795.

Figure 9:
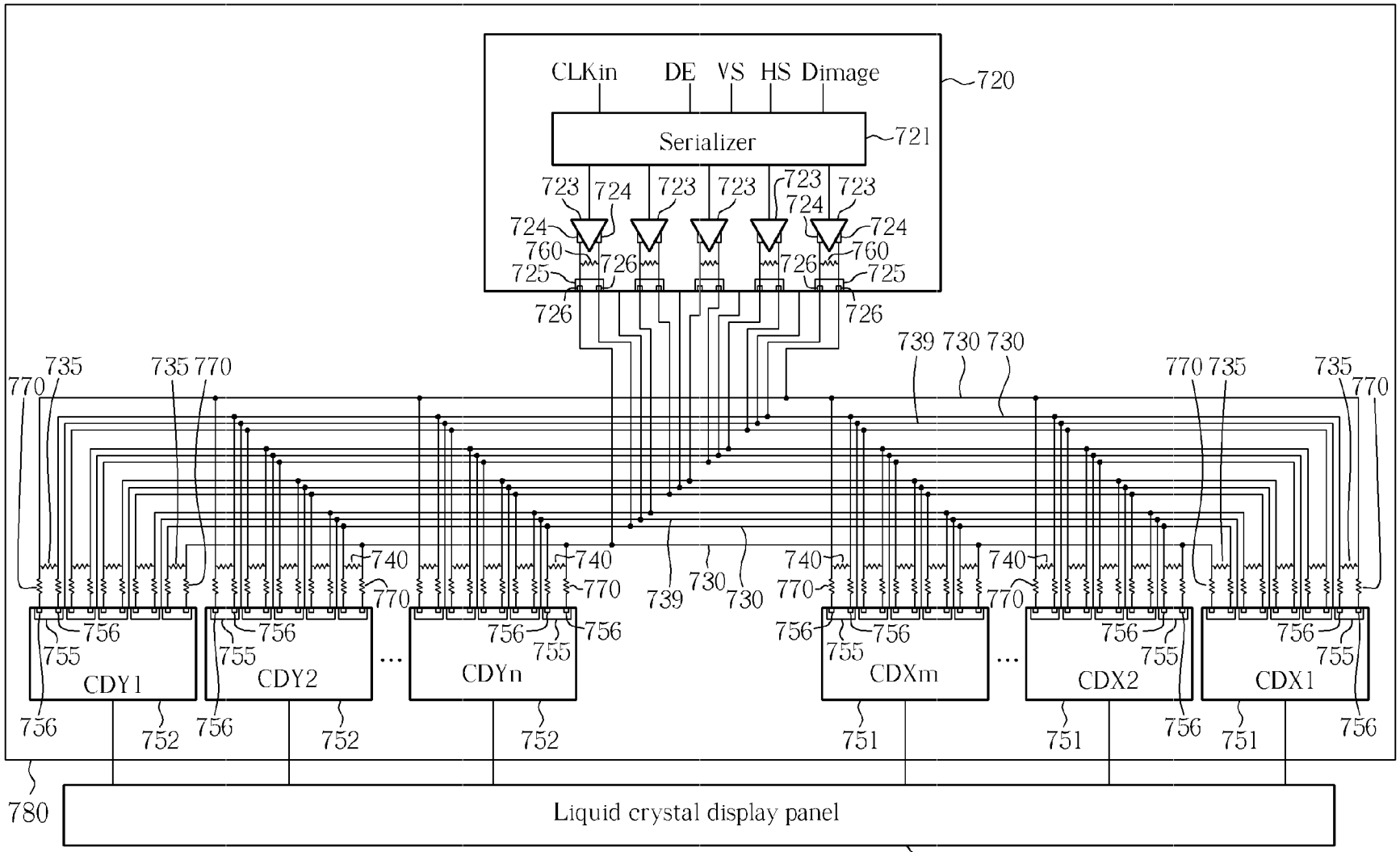
FIG. 9 is a structural diagram schematically showing a driving apparatus in accordance with an eighth embodiment of the present invention.

FIG. 9 is a structural diagram schematically showing a driving apparatus in accordance with an eighth embodiment of the present invention. As shown in FIG. 9, the driving apparatus 780 comprises the timing controller 720, the plurality of pairs of transmission lines 730, a plurality of shielding lines 739, the plurality of terminal resistors 735, a plurality of second auxiliary resistors 740, a plurality of third auxiliary resistors 770, the plurality of right-side source driving circuits 751 and the plurality of left-side source driving circuits 752. The two input ends 756 of each input port 755 of the right-side source driving circuits CDX2~CDXm are coupled with one corresponding second auxiliary resistor 740. Also, the two input ends 756 of each input port 755 of the left-side source driving circuits CDY2~CDYn are coupled with one corresponding second auxiliary resistor 740. Each third auxiliary resistor 770 is coupled between a corresponding transmission line 730 and a corresponding input end 756 of one corresponding right-side source driving circuit 751 or left-side source driving circuit 752. All the shielding lines 739 are configured to receive a ground voltage or a fixed voltage. Each shielding line 739 is disposed between adjacent pairs of transmission lines 730 for avoiding crosstalk interference regarding adjacent pairs of transmission lines 730 so as to improve signal quality. The driving apparatus 780 is similar to the driving apparatus 710 shown in FIG. 8, differing only in that the second auxiliary resistors 740, the third auxiliary resistors 770 and the shielding lines 739 are added, and therefore further similar discussion thereof is omitted. In another embodiment, only the two input ends 756 of each input port 755 of the mth right-side source driving circuit CDXm and the nth left-side source driving circuit CDYn are coupled with a corresponding second auxiliary resistor 740, i.e. the two input ends 756 of each input port 755 of the source driving circuits CDX2~CDXm-1 and CDY2~CDYn-1 are not coupled with any second auxiliary resistor 740.

Figure 10:
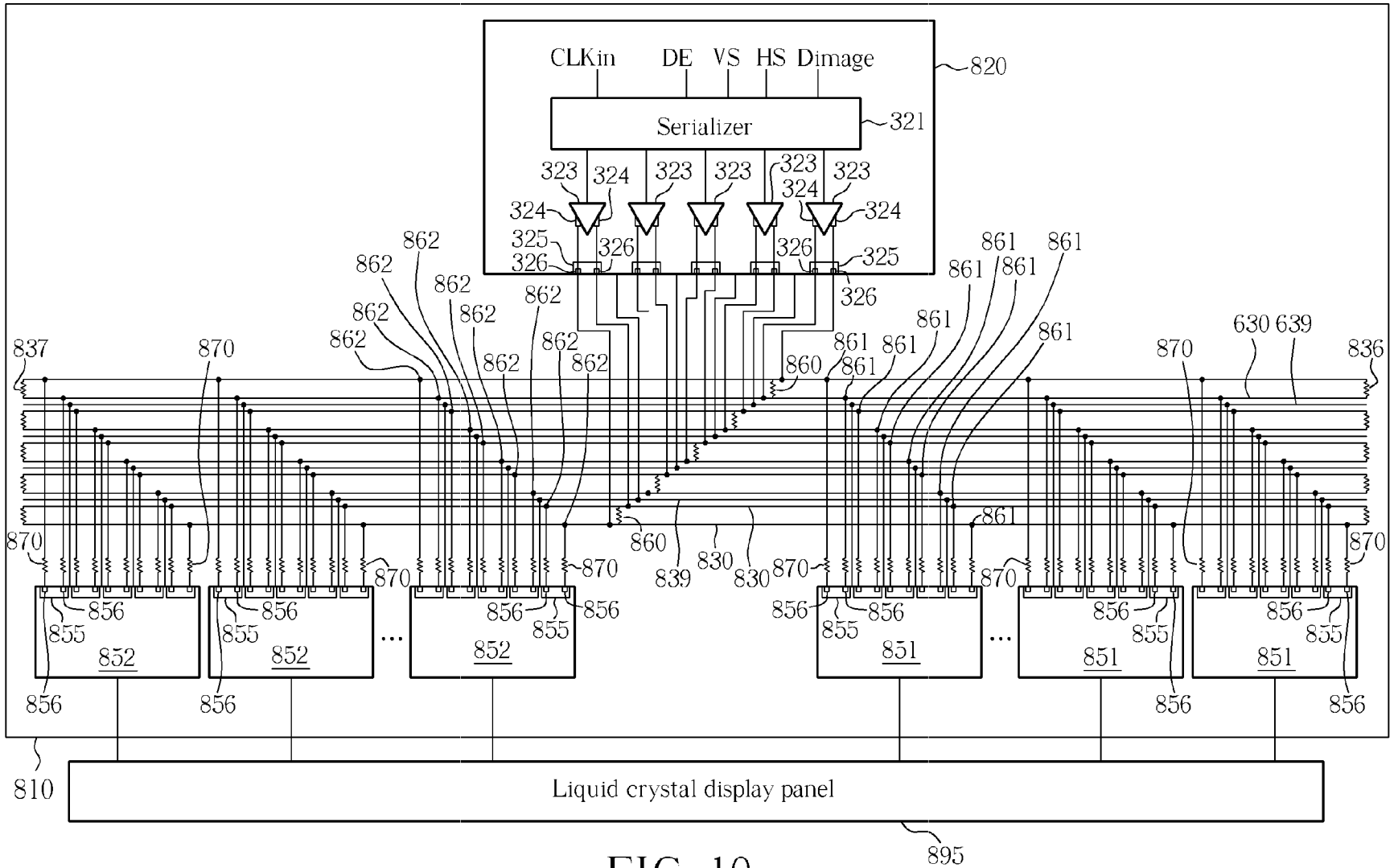
FIG. 10 is a structural diagram schematically showing a driving apparatus in accordance with a ninth embodiment of the present invention.

FIG. 10 is a structural diagram schematically showing a driving apparatus in accordance with a ninth embodiment of the present invention. As shown in FIG. 10, the driving apparatus 810 comprises a timing controller 820, a plurality of pairs of transmission lines 830, a plurality of shielding lines 839, a plurality of first terminal resistors 836, a plurality of second terminal resistors 837, a plurality of first auxiliary resistors 860, a plurality of second auxiliary resistors 870, a plurality of right-side source driving circuits 851 and a plurality of left-side source driving circuits 852. Each first terminal resistor 836 is coupled between two first terminals of one corresponding pair of transmission lines 830. Each second terminal resistor 837 is coupled between two second terminals of one corresponding pair of transmission lines 830. All the shielding lines 839 are configured to receive a ground voltage or a fixed voltage. Each shielding line 839 is disposed between adjacent pairs of transmission lines 830 for avoiding crosstalk interference regarding adjacent pairs of transmission lines 830 so as to improve signal quality. The internal structure of timing controller 820 is identical to that of the timing controller 320 shown in FIG. 1. Each first auxiliary resistor 860 is coupled between the two output ends 326 of one corresponding output port 325 of the timing controller 820. As shown in FIG. 10, the first auxiliary resistors 860 are actually disposed between a plurality of nodes 861 and a plurality of nodes 862 adjacent to the output ports 325 of the timing controller 820.

Each right-side source driving circuit 851 comprises a plurality of input ports 855. Each input port 855 comprises two input ends 856 coupled to a corresponding pair of transmission lines 830 for receiving a corresponding differential signal. The couple-related structure of each left-side source driving circuit 852 is identical to that of the right-side source driving circuit 851. Each second auxiliary resistor 870 is coupled between a corresponding transmission line 830 and a corresponding input end 856 of one corresponding right-side source driving circuit 851 or left-side source driving circuit 852. The right-side source driving circuits 851 and the left-side source driving circuits 852 are put in use for generating a plurality of data signals based on the differential signals received from the plurality of pairs of transmission lines 830. The data signals are forwarded to drive a liquid crystal display panel 895 for illustrating images.

In summary, by means of rearranging coupling relationships regarding the terminal resistors or adding auxiliary resistors, the driving apparatus of the present invention is able to improve the signal integrity of the differential signal received by source driving circuits, i.e. the differential signal received by the source driving circuits has a wider width or a greater length of the corresponding eye pattern region. Accordingly, compared with the prior-art driving apparatus, the driving apparatus of the present invention is more suitable for performing high-frequency operation and is able to tolerate higher noise for reducing the voltage-level misjudging rate of high-frequency differential signals under processing.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A driving apparatus for driving a liquid crystal display panel, the driving apparatus comprising:

a timing controller for generating a plurality of differential signals, the timing controller having a plurality of output ports, each of the output ports having two output ends for outputting a corresponding differential signal;

a plurality of pairs of transmission lines, each pair of transmission lines having two transmission lines respectively coupled to the two output ends of a corresponding output port of the timing controller for receiving a corresponding differential signal;

a plurality of shielding lines for receiving a ground voltage or a fixed voltage, each of the shielding lines being disposed between adjacent pairs of transmission lines;

a plurality of source driving circuits for generating a plurality of data signals furnished to the liquid crystal display panel based on the differential signals, each source driving circuit being coupled to the plurality of pairs of transmission lines for receiving the differential signals, the source driving circuit comprising:

a plurality of input ports, each of the input ports having two input ends coupled to a corresponding pair of transmission lines;

a plurality of first terminal resistors, each of the first terminal resistors being coupled between two first terminals of a corresponding pair of transmission lines; and a plurality of first auxiliary resistors coupled to the transmission lines between the timing controller and the source driving circuits.

2. The driving apparatus of claim 1, wherein the first auxiliary resistor is coupled between two corresponding transmission lines adjacent to a corresponding output port of the timing controller.

3. The driving apparatus of claim 1, wherein the first auxiliary resistor is coupled between a corresponding transmission line and a corresponding input end of a corresponding source driving circuit.

4. The driving apparatus of claim 1, wherein the source driving circuits comprise a first set of source driving circuits and a second set of source driving circuits, the timing controller is coupled to the first and second sets of source driving circuits, and the first set of source driving circuits is positioned between the timing controller and the first terminals of the transmission lines.

5. The driving apparatus of claim 4, wherein each of the first auxiliary resistors is coupled between a corresponding transmission line and a corresponding input end of a corresponding source driving circuit in the first set of source driving circuits.

6. The driving apparatus of claim 4, further comprising:

a plurality of second terminal resistors, each of the second terminal resistors being coupled between two second terminals of a corresponding pair of transmission lines;

wherein the second set of source driving circuits is positioned between the timing controller and the second terminals of the transmission lines.

7. The driving apparatus of claim 4, further comprising:

a plurality of second auxiliary resistors, each of the second auxiliary resistors being coupled between a corresponding transmission line and a corresponding input end of a corresponding source driving circuit in the second set of source driving circuits.

* * * * *